United States Patent [19]

Frigo

[11] 4,007,703

[45] Feb. 15, 1977

[54] TWO-TONE SOUND GENERATOR

[75] Inventor: Domenico Frigo, Olmo, Italy

[73] Assignee: F.I.A.M.M. Fabbrica Italiana Accumulatori Motocarri Montecchio S.p.A., Montecchio Maggiore (Vicenza), Italy

[22] Filed: Feb. 27, 1976

[21] Appl. No.: 662,169

[52] U.S. Cl. ..... 116/142 FP; 116/137 R

[51] Int. Cl.[2] ..... G10K 9/18

[58] Field of Search ..... 116/140, 137 R, DIG. 18, 116/DIG. 19, 142 R, 142 FP; 181/193, 185

[56] References Cited

UNITED STATES PATENTS 3,477,405 11/1969 Jensen ..... 116/137 R

FOREIGN PATENTS OR APPLICATIONS 962,067 12/1973 Italy ..... 116/137 R

*Primary Examiner*—Donald O. Woodiel
*Assistant Examiner*—Denis E. Corr
*Attorney, Agent, or Firm*—Karl F. Ross; Herbert Dubno

[57] ABSTRACT

A two-tone signal generator, serving as a horn for automotive vehicles, comprises two complementary half-shells whose interior is divided by a common partition into two convoluted wind channels of different length resonating at different frequencies and opening into a common outlet. The inlet to the wind channels comprises a central duct with two lateral branches terminating at a pair of nipples to which a hose from an air blower can be selectively fitted; the junction of the branches with the central duct is an enlarged space containing a freely movable rubber ball which automatically blocks one nipple when air is admitted through the other nipple. The duct communicates with the two wind channels via respective lateral chambers formed in the two half-shells, each chamber being partly closed toward the outside by a lid provided with an eccentric air slot. The two air slots, flanked by splash shields, are disposed at diagonally opposite locations and communicate with drains and an inter-chamber passageway facilitating the discharge of moisture which may penetrate from the outside into the instrument. The two half-shells have confronting peripheral grooves that extend over an arc of approximately 120° and receive a slider by which the instrument may be attached in various positions to an external mounting.

10 Claims, 8 Drawing Figures

TWO-TONE SOUND GENERATOR

FIELD OF THE INVENTION

My present invention relates to an acoustic signal generator and, more particularly, to a two-tone sound emitter adapted to be used as a horn for automotive vehicles.

BACKGROUND OF THE INVENTION

In my Italian Pat. No. 962,067 I have disclosed a dual horn with a pair of convoluted wind channels separated by a curved partition, i.e. a longer outer channel and a shorter inner channel, terminating in a common bell-shaped outlet. Upon the admission of air under pressure to the entrance ends of the two wind channels remote from the bell, sounds of higher and lower pitch are respectively generated in the inner and in the outer channel as an acoustic signal.

OBJECTS OF THE INVENTION

An object of my present invention is to provide an improved two-tone signal generator of this character adapted to be installed in various positions, according to need or convenience, on an external support such as the chassis of an automobile.

Another object is to provide a horn construction designed to avoid the accumulation of rain water in its interior.

SUMMARY OF THE INVENTION

A dual-horn instrument according to my invention has a hollow body divided into two complementary half-shells, preferably of plastic material, meeting along a median plane bisecting the two convoluted wind channels which are formed, as in my prior Italian patent, by a curved septum or partition extending into the two half-shells. A common inlet for the two wind channels, formed by these half-shells, includes a central duct which is bisected by the median plane and forms a generally T-shaped junction with two lateral branches partly constituted, in a preferred embodiment, by bores of oppositely facing nipples. A mobile valve member, such as an elastic ball, is disposed in an enlarged space of the T-junction bounded by a pair of shoulders which may be formed by the two nipples; upon the blowing of air under pressure into either of the branches, the mobile ball blocks the opposite branch by coming to rest against the corresponding shoulder. The central duct is connected with the entrance ends of the two wind channels with the aid of guide means in each half-shell, the guide means advantageously including inserts in a pair of lateral chambers which communicate with the central duct and with the respective entrance ends.

In order to provide the necessary communication between the lateral chambers and the outside air, the inserts can be shaped as generally coaxial cups with outwardly facing mouths spanned by perforated membranes which are overlain by apertured lids. Advantageously, each cup-shaped insert is loosely fitted into a collar which is spacedly surrounded by a peripheral wall of a respective half-shell, the collar and the wall defining an annular trough overlain by the associated lid. The venting perforations of the lids may comprise a pair of air slots, one on each lid, at locations which are diametrically opposite with reference to the more or less coincident cup axes. The troughs may be interconnected by a transverse passage and may open to the exterior through drain holes remote from that passage.

Pursuant to a further feature of my invention, the two half-shells are provided with confronting peripheral grooves forming an arcuate track for a slider which is displaceable therein and is provided with fastening means for attaching same to an external mounting while immobilizing the slider in a selected position on the instrument body.

BRIEF DESCRIPTION OF THE DRAWING

The above and other features of my invention will now be described in detail with reference to the accompanying drawing in which.

SPECIFIC DESCRIPTION

Figure 1:
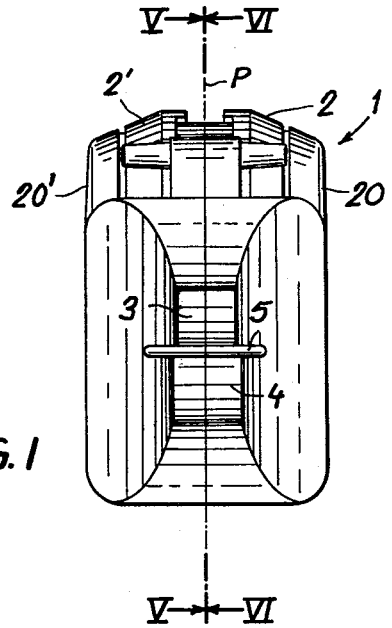
FIG. 1 is an end-elevational view of a signal generator according to my invention.
Figure 8:
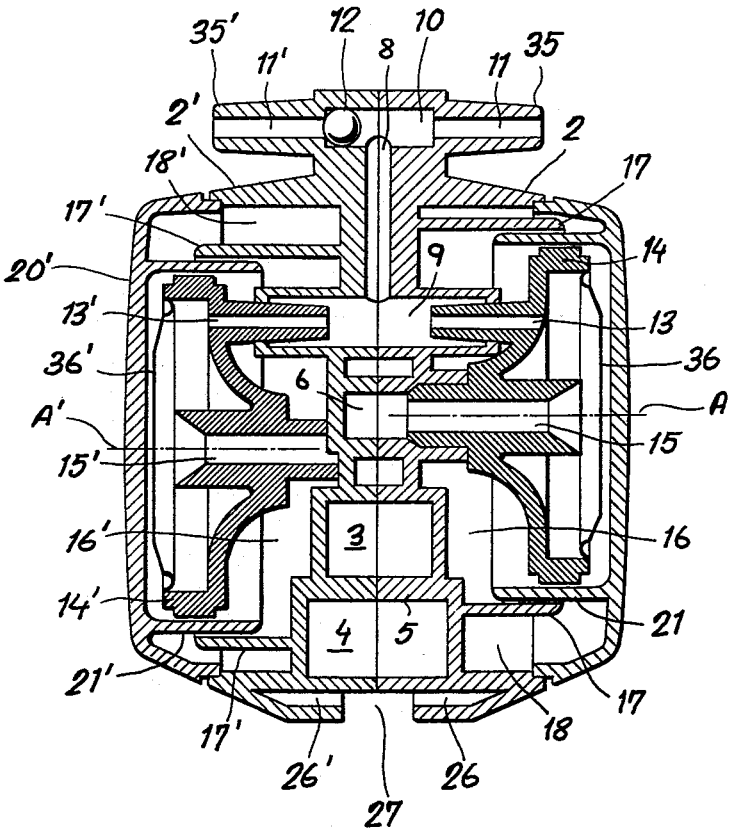

The horn according to my invention, viewed in FIG. 1 from its bell-shaped outlet end, comprises a hollow body 1 split into two half-shells 2 and 2′ which may be joined together along a median plane P by adhesive bonding or other suitable means. These half-shells may be produced by injection or compression molding from any suitable plastic material. The interior of body 1 is divided by a curved septum 5 into two convoluted wind channels 3 and 4, the inner channel 3 being shorter than the outer channel 4 so as to generate a tone of higher pitch. Septum 5, extending transversely to plane P and bisected thereby, terminates close to the mouth of the bell and at its opposite end forms the boundaries for two entrance ports 6 and 7 of channels 3 and 4, respectively, these entrance ports being respectively open toward half-shells 2 and 2′ as best seen in FIG. 8 for the port 6. FIG. 8 also shows a pair of tubular stems 15 and 15′ of two generally cup-shaped inserts 14 and 14′ received with close fit in ports 6 and 7, respectively, these inserts being provided with tubular bosses 13 and 13′ press-fitted from opposite sides into a transverse branch 9 of a central inlet duct 8. This duct, constituted by complementary grooves of half-shells 2 and 2′, also has two other transverse branches 11 and 11′ forming with it a T-junction with an enlarged middle zone 10 bounded by a pair of lateral shoulders, branches 11 and 11′ being constituted beyond these shoulders by the bores of a pair of nipples 35, 35′ to which a hose from a nonillustrated air blower of an automotive vehicle may be selectively fitted. A rubber ball 12 in zone 10 serves as a mobile valve member blocking either of these nipples if air under pressure is admitted through the other nipple. Thus, the instrument may be mounted under the hood of a vehicle in whatever position is most convenient, regardless of the location of the air supply.

Inserts 14 and 14′ are seated in respective chambers 16 and 16′ of half-shells 2 and 2′, these chambers being bounded by annular collars 17 and 17′ integrally formed on the two half-shells. The collars, in turn, are spacedly surrounded by the peripheral walls of the half-shells defining therewith a pair of annular troughs 18 and 18′ of varying widths. Two lids 20 and 20′ are fitted onto those peripheral walls so as to overlie the troughs 18 and 18′ as well as the outwardly facing mouths of the cup-shaped inserts 14 and 14′, these mouths being spanned by respective membranes or diaphragms 36, 36′ provided with nonillustrated perforations in the vicinity of the cup axes A and A′.

Figure 2:
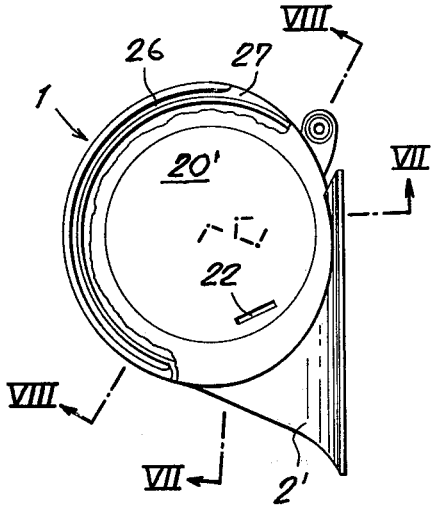
FIG. 2 is a side view of the signal generator of FIG. 1.
Figure 7:
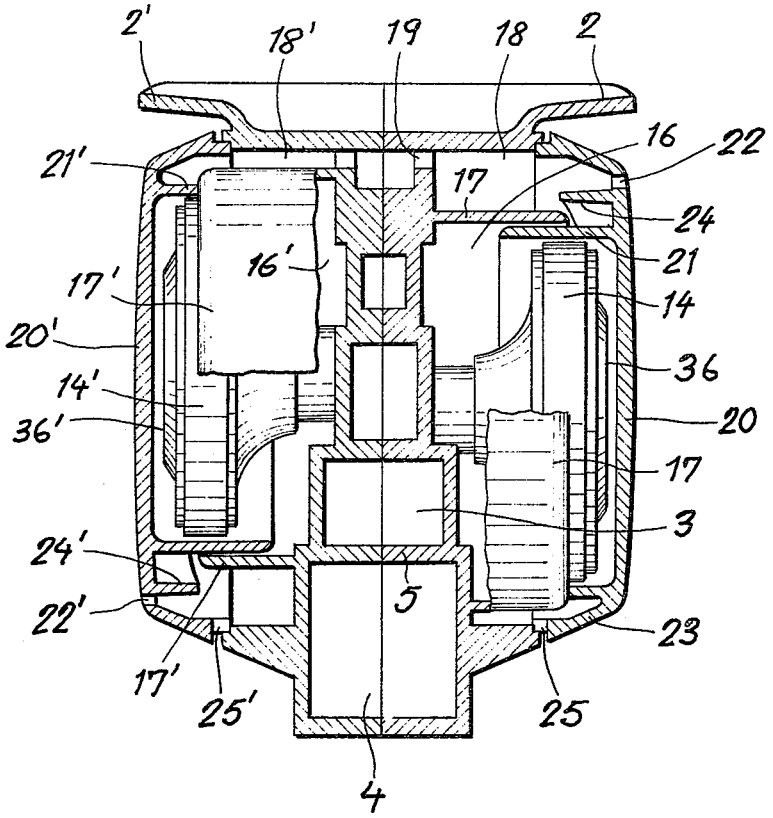
FIGS. 7 and 8 are cross-sectional views respectively taken on the lines VII — VII and VIII — VIII of FIG. 2.

The lids 20 and 20′ are integrally formed with annular skirts 21 and 21′ loosely fitting between the inserts 14, 14′ and the surrounding collars 17, 17′. Air blown in through one of the nipples 35, 35′, entering the inserts 14 and 14′ through their inlets 13 and 13′, passes along the membranes 36 and 36′ before entering the two wind channels 3 and 4 via stems 15 and 15′. Part of that air may escape through the perforated membranes and the clearances between inserts 14, 14′, skirts 21, 21′ and collars 17, 17′ into the surrounding troughs 18 and 18′ which are interconnected by a transverse passage 19 and communicate with the outer atmosphere through a pair of diametrically opposite venting slots 22 and 22′ as seen in FIGS. 2 and 7. The membranes are thus free to vibrate in helping to generate the notes produced by the associated wind channels.

The venting slots 22, 22′ are located at the widest portions of the respective troughs 18, 18′ and are flanked by respective arcuate splash shields 24, 24′ partly overlapping the collars 17, 17′. At locations remote from the interconnecting passage 19, drain holes 25 and 25′ are provided between the lids 20, 20′ and the walls of the respective half-shells 2, 2′.

Any precipitation penetrating through one or the other slot 22, 22′ will be diverted by the adjoining splash shield 24 or 24′ from the neighboring air chamber 16 or 16′ and will quickly find its way to one of the drain holes 25 or 25′ either directly or by way of passage 19. Whatever moisture may penetrate into these chambers will not have a chance to accumulate to the level of the perforations of membranes 36 and 36′; thus, there will be no interference with the operation of the horn in practically any position of its body.

Figure 4:
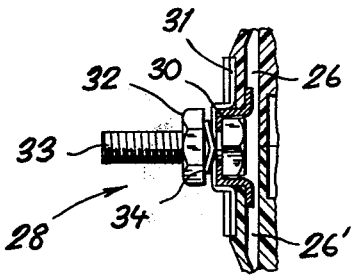
FIG. 4 is an enlarged sectional detail view of an area designated IV in FIG. 3.
Figure 3:
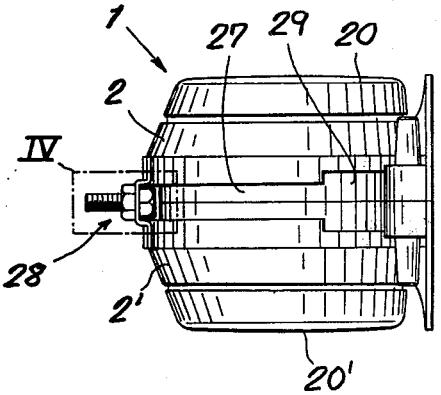
FIG. 3 is a top view of same.
Figure 6:
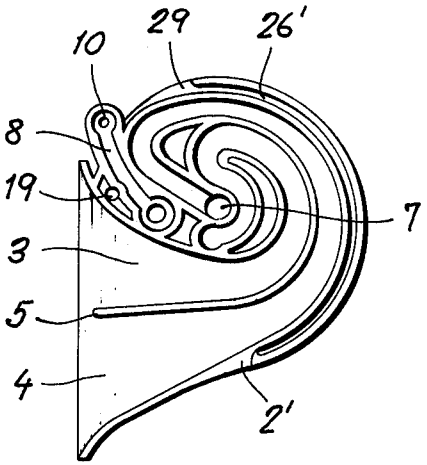
FIGS. 5 and 6 are face views of respective halves of the signal generator as viewed in the directions V — V and VI — VI of FIG. 1.
Figure 5:
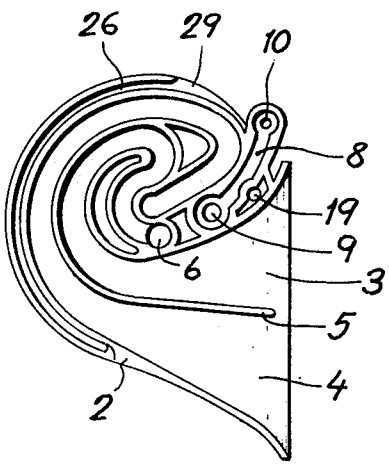

As best seen in FIGS. 5, 6 and 8, half-shells 2 and 2′ are integrally formed with arcuate lips bounding a pair of confronting grooves 26 and 26′ defining a track 27 which extends around the body 1 over an arc of roughly 120°. This track is adapted to receive a slider 28, FIGS. 3 and 4, which includes a stirrup 30 with legs fitting into the grooves 26 and 26′ upon insertion into the track at a recess 29. Stirrup 30 embraces the head of a bolt 33 carrying a nut 32 which bears upon upstanding wings 34 of a resilient yoke 31 coacting with stirrup 30 to clamp the slider 28 in any desired position along the track 27 upon a tightening of nut 32. The same nut, or another one, may be used to secure the slider 28 and with it the instrument body 1 to any external mounting.

It will thus be seen that I have provided a two-tone signal generator, usable as an automobile horn, which can be mounted in a variety of positions and will not be adversely affected by precipitation entering its interior.

I claim:

1. A two-tone signal generator comprising:

a hollow body divided into two complementary half-shells meeting along a median plane;

a curved septum dividing the interior of said body into two convoluted wind channels of different length each bisected by said median plane, said wind channels terminating in a common bell open to the exterior, said half-shells forming a common inlet for said wind channels, said inlet including a central duct bisected by said median plane and two lateral branches with confronting internal shoulders forming a generally T-shaped junction with said duct;

a mobile valve member in said junction freely displaceable between said shoulders for blocking either of said branches upon a blowing of air under pressure into the opposite branch; and guide means in each of said half-shells for directing incoming air from said central duct to an end of a respective wind channel remote from said bell.

2. A signal generator as defined in claim 1 wherein said half-shells are provided with oppositely facing nipples forming said shoulders, said nipples being provided with bores constituting part of said branches.

3. A signal generator as defined in claim 1 wherein said valve member is an elastic ball.

4. A signal generator as defined in claim 1 wherein said half-shells form a pair of lateral chambers each communicating with said central duct and with a respective wind-channel end, said guide means including inserts in said chambers.

5. A signal generator as defined in claim 4 wherein said inserts are two cups with axes substantially perpendicular to said median plane and with outwardly facing mouths spanned by membranes.

6. A signal generator as defined in claim 5 wherein said chambers are bounded by collars surrounding said cups, said half-shells having peripheral walls spacedly surrounding said collars and defining therewith two annular troughs respectively encircling said chambers, said half-shells being further provided with apertured lids overlying said troughs and said membranes.

7. A signal generator as defined in claim 6 wherein said troughs are of varying widths and have widest portions at diametrically opposite locations with respect to said axes, said lids being provided with air slots overlying the widest portions of the respective troughs.

8. A signal generator as defined in claim 7 wherein said half-shells form a passage traversing said median plane and interconnecting said troughs, said lids being further provided with internal splash shields adjacent said air slots, said peripheral walls engaging said lids and forming therewith a pair of drain holes at locations remote from said passage.

9. A signal generator as defined in claim 1 wherein said half-shells form a peripheral track, further comprising a slider displaceable along said track and provided with fastening means for attaching same to an external mounting while immobilizing said slider in a selected position on said body.

10. A signal generator as defined in claim 9 wherein said track is formed by confronting grooves of said half-shells extending on opposite sides of said median plane.

* * * * *